US007017481B2

(12) United States Patent
Bechberger et al.

(10) Patent No.: US 7,017,481 B2
(45) Date of Patent: Mar. 28, 2006

(54) METHOD OF OPERATING A PRESS AND PRINTING PRESS

(75) Inventors: Thomas Bechberger, Östringen (DE); Jörg Heuschkel, Viernheim (DE); Wolfram Kolbe, Heidelberg (DE); Michael Münster, Lampertheim (DE); Dieter Schaffrath, Lorsch (DE); Ralf Schmitt, Leimen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/856,253

(22) Filed: May 28, 2004

(65) Prior Publication Data

US 2004/0237815 A1 Dec. 2, 2004

(30) Foreign Application Priority Data

May 28, 2003 (DE) ..... 103 24 536

(51) Int. Cl.
*B41F 7/26* (2006.01)

(52) U.S. Cl. ..... 101/147; 101/148

(58) Field of Classification Search ..... 101/147, 101/148

See application file for complete search history.

(56) References Cited

U.S. PATENT DOCUMENTS

| | | | | |
|---|---|---|---|---|
| 0,000,004 | A * | 8/1836 | Blanchard | 142/10 |
| 3,842,735 | A | 10/1974 | Southam et al. | |
| 4,022,125 | A * | 5/1977 | Weaver | 101/148 |
| 4,351,236 | A * | 9/1982 | Beisel et al. | 101/148 |
| 4,440,081 | A | 4/1984 | Beisel | |
| 4,922,818 | A * | 5/1990 | Junghans | 101/148 |
| 5,471,926 | A | 12/1995 | Junghans et al. | |
| 5,520,109 | A * | 5/1996 | Meschi | 101/247 |
| 6,257,144 | B1 | 7/2001 | Erhardt et al. | |
| 6,336,403 | B1 * | 1/2002 | Pitman | 101/148 |

FOREIGN PATENT DOCUMENTS

| | | |
|---|---|---|
| DE | 24 32 576 A1 | 1/1976 |
| DE | 82 04 506.2 U1 | 8/1982 |
| DE | 93 05 742.3 U1 | 7/1993 |
| DE | 199 21 628 A1 | 12/1999 |
| EP | 0 080 588 B1 | 6/1983 |

* cited by examiner

*Primary Examiner*—David M. Gray
*Assistant Examiner*—Joshua Zimmerman
(74) *Attorney, Agent, or Firm*—Laurence A. Greenberg; Werner H. Stemer; Ralph E. Locher

(57) ABSTRACT

A method of operating a press that has a damping unit which contains a damping unit roller is performed during a printing interruption. During the printing interruption, the damping unit roller is supplied discontinuously with damping solution replenishment and, as a result, the damping unit roller is kept ready for a printing operation.

12 Claims, 3 Drawing Sheets

METHOD OF OPERATING A PRESS AND PRINTING PRESS

BACKGROUND OF THE INVENTION

FIELD OF THE INVENTION

The present invention relates to a method of operating a printing press having a damping unit which includes a damping unit roller during a printing interruption.

Under specific circumstances, some damping unit rollers exhibit a tendency to undesired set-off of the printing ink on the roller surface. In Published, Non-Prosecuted German Patent Application DE 24 32 576 A1, roughening of the roller surface is proposed in order in this way to counteract what is known as a build-up of ink. However, the countermeasure is ineffective during a printing interruption, in particular one that lasts for a long time. In practice, it has been shown that when a printing operation is resumed, the damping unit roller and, consequently, the printing form do not correctly run free. This in turn results in a smeared halftone print.

Cleaning of the relevant damping unit roller also provides a remedy only for too short a service period and costs too much maintenance time.

The functional impairment cannot be avoided either by a roughened roller surface configured in another way (for example according to German Utility Patent DE 93 05 742 U1, corresponding to U.S. Pat. No. 5,471,926).

In order to solve the problem, the prior art was not able to provide any helpful contribution either. This includes European Patent EP 0 080 588 B1, in which a description is given of a damping unit in which, when it is thrown on, first a transfer roller is thrown onto an applicator roller and the applicator roller is then thrown onto a printing form cylinder. A damping unit roller with a roughened surface formed of chromium rests on the applicator roller of the damping unit. Also belonging to the prior art is German Utility Patent DE 82 04 506 U1, in which a description is given of a damping unit whose transfer roller is brought into and out of contact periodically with an applicator roller during continuous printing operation, in order to interrupt the supply of damping solution briefly with regard to the passage of a cylinder channel of the printing form cylinder.

SUMMARY OF THE INVENTION

It is accordingly an object of the invention to provide a method of operating a press and a printing press which overcome the above-mentioned disadvantages of the prior art devices and methods of this general type, which permits printing operation to be resumed without problems even after very long printing interruptions.

With the foregoing and other objects in view there is provided, in accordance with the invention, a method of operating a press, containing a damping unit having a damping unit roller. The method includes, during a printing interruption, supplying the damping unit roller discontinuously with damping solution replenishment and, as a result, the damping unit roller is kept ready for a printing operation.

The method according to the invention relates to operating a press having a damping unit that contains a damping unit roller during a printing interruption. During the printing interruption, the damping unit roller is supplied discontinuously with damping solution replenishment and, as a result, the damping unit roller is kept ready for the printing operation.

In this connection, "discontinuously" is defined as the damping solution replenishment is not supplied uninterruptedly to the damping unit roller during the entire printing interruption.

The advantages achieved by the method according to the invention are numerous. As a result of the intermediate damping of the damping unit roller carried out during the printing interruption, the printing ink/damping solution emulsion on the damping unit roller can be maintained with a damping solution content to a sufficient extent and can be kept from drying out. By refreshing the emulsion temporarily stored on the damping solution roller, its damping solution depletion caused by evaporation of its damping solution can be counteracted.

As a result of the damping solution replenishment, however, not only is the evaporated damping solution volume at least partly compensated for but, furthermore, the percentage of printing ink proportion of the emulsion is prevented from growing excessively as a result of the disappearance of damping solution and, as a result, the printing ink is prevented from collecting irreversibly to an increasing extent on the damping unit roller. The discontinuous redamping of the damping unit roller thus prevents the emulsion on it from drying out and secures the readiness of the damping unit roller to be used at any time in the printing operation to be dealt with. When the operating method according to the invention is used, even relatively long idling phases of the press can be covered without problems.

Cleaning the damping unit roller preceding the resumption of the printing operation after the printing interruption is no longer necessary.

In addition, the amount of rejects necessarily associated with the resumption of the printing operation for various reasons is noticeably reduced and rapid free running of the printing form and a satisfactory halftone print are ensured.

Although it is in principle possible to implement the method according to the invention by a damping unit equipped with a damping solution spraying device, in which a spraying surge is carried out as a damping solution replenishment during the printing interruption, the implementation by a pure roller damping unit (without spraying device) is given preference.

A development which is advantageous with regard to the implementation of the method by a roller damping unit is characterized in that the damping solution replenishment is supplied discontinuously to the damping unit roller by a nip within the damping unit first being closed during the printing interruption, so that the damping solution replenishment is supplied to the damping unit roller via the nip, and then being opened again. The nip is formed by two rollers of the damping unit together. When they are closed, at least one of the two rollers is thrown onto the other. The two rollers are preferably rollers which are different from the damping unit roller to which the damping solution replenishment is ultimately to be supplied, namely an applicator roller and a transfer roller. By definition, the applicator roller rests on the printing form cylinder during printing operation. By definition, the transfer roller, during printing operation, rests simultaneously on two rollers, for example on a dip roller and the applicator roller, in order to transfer the damping solution from the roller arranged upstream in the roller train (dip roller) to the roller disposed downstream (applicator roller). When the nip is closed, the two rollers forming the nip are in rolling contact with each other, so the damping solution replenishment is transferred from the one roller forming the nip to the other. When the nip is opened, the rolling contact no longer exists. Although the damping unit used in accordance with the development described here is a "doctorless damping unit" ("continuous-type inking system"), which operates continuously in printing operation, one of the two rollers forming the nip carries out a type of ductor roller movement during the printing interruption, in order to transfer or accept the damping solution replenishment.

In a further development, which is advantageous with regard to the intermittent redamping of the damping unit roller over an extremely long printing interruption, during the printing interruption the closure of the nip permitting the damping solution replenishment and the opening of the nip are repeated alternating with each other. It is therefore inherent in the development described here that, in the course of the printing interruption, the nip is closed more than once and is opened again more than once. The repetitions of this closure and opening are preferably carried out at periodic intervals in each case. Depending on the periodicity of the damping solution replenishment, one roller forming the nip, for example the transfer roller, can be thrown onto the other roller, for example the applicator roller, in each case following a specific time or a specific number of machine revolutions, and can be maintained in this thrown-on position for a specific time or over a specific number of machine revolutions. For example, for every one hundred revolutions (nip closure interval) of the printing form cylinder the transfer roller can be thrown onto the applicator roller for ten revolutions (intermediate damping interval) of the printing form cylinder. The frequency or the mark/space ratio or the interval lengths of the closure and opening of the nip can be changed in the course of the printing interruption, depending on a predetermined movement profile or pattern. For instance, with increasing duration of the printing interruption, the number of machine revolutions for which a wait is made between a respective nip closure operation and the next nip closure operation can be reduced in accordance with the movement profile and/or the number of machine revolutions for which a wait is made between a respective nip closure operation and the next nip opening operation can be increased in accordance with the movement profile. For example, this results in that the transfer roller is thrown more frequently onto the applicator roller and/or for a longer time as the duration of the printing interruption increases. However, the aforementioned parameters (frequency, mark/space ratio, interval lengths) of the movement profile can instead also be kept constant during the entire printing interruption.

According to further developments, which are particularly advantageous when taken together, provision can be made, during the printing interruption, for the damping unit roller and a dip roller of the damping unit to be driven jointly in rotation by a first motor and, during printing operation, for the dip roller to be driven in rotation by the first motor and, at the same time, for a printing form cylinder to which the damping unit is assigned and the damping unit roller to be driven jointly in rotation by a second motor. The printing form cylinder to which the damping unit is assigned can be at a rotational standstill during the printing interruption. The second motor can be an electric main drive of the press and can be stationary during the printing interruption or uncoupled from the printing form cylinder, so that the printing form cylinder is at a rotational standstill during the intermediate damping, that is to say the supply of the damping solution replenishment. The first motor can be an electric individual or separate drive of the damping unit and can drive the damping unit roller in rotation together with the dip roller during the intermediate damping. In order that the damping unit roller can be driven by the first motor during the printing interruption and, instead, by the second motor during the printing operation, that is to say by a different motor in each of the operating modes, the damping unit roller is uncoupled from the second motor during the one operating mode change "printing operation—printing interruption" and, during the next operating mode change "printing interruption—printing operation", that is to say when the printing operation is resumed, is coupled to the second motor again.

According to a further development, the damping unit roller to be conditioned for the printing operation by the intermediate damping is a roller having a roughened surface. The roughness (surface structure or relief) of the roller surface can be provided by an irregular structure, for example a graduation, or a regular structure, for example engraving.

The surface structure of the damping unit roller preferably corresponds to the damping solution distributor forming the subject of Published, Non-Prosecuted Patent Application DE 24 32 576 A1 or that of the damping solution distributor roller of the damping unit forming the subject of German Utility Patent DE 93 05 742 U1. The surface relief determining the roughness of the circumferential surface of the damping unit roller used according to the invention can also be structured in a substantially inverse manner, that is to say with domes or knobs instead of with cells, relative to the surface relief of the damping solution distributor roller from DE 93 05 742 U1. The two documents DE 24 32 576 A1 and DE 93 05 742 U1 are hereby incorporated by reference in the disclosure content of the description of the invention for the purpose of better understanding of the roughness of the surface structure.

In connection with the present invention, it has been recognized that the teaching given in Published, Non-Prosecuted German Patent Application DE 24 32 576 A1, according to which only a little printing ink would collect on a roughened damping solution roller, since the depressions in the roughness would always carry damping solution, does not apply under all circumstances. It has been discovered that, in the event of unfavorable material properties of the substances involved in the printing process (printing form, printing ink, damping solution, detergent etc.) and, added to this, in the case of extremely long printing interruptions and the damping solution disappearance associated with this, the action of the roughness which is advantageous during printing operation threatens, without suitable countermeasures, to invert into its opposite, that is to say that the damping solution roller, because of its roughness, actually tends to cause over inking with printing ink to a particularly severe extent in this special operating situation. The countermeasure taken in accordance with the invention is the damping solution replenishment carried out discontinuously during the printing interruption, that is to say the aforesaid intermediate damping of the damping unit roller.

If the damping unit roller to be conditioned by the intermediate damping is a hydrophilic roller, for example a roller with a chromium—plated roller surface, permanent maintenance of the desired water-friendly surface action of the damping unit roller is ensured by the intermediate damping.

In connection with the present invention, it has further been discovered that the damping unit roller must be intermediately dampened in particular when the damping unit roller is a roller which is in single rolling contact—that is to say a pure storage roller and not a transfer roller. The rolling contact can be provided, for example, by the damping unit roller resting only on one of the two rollers forming the nip that can be closed and opened and not on any further rollers. The roller on which the damping unit roller rests is preferably the applicator roller that has already been mentioned and forms the nip together with the transfer roller.

The press according to the invention has a damping unit that contains a damping unit roller and an electronic control device for controlling the damping unit. The control device is configured to implement the method according to the invention or one of its developments.

In terms of its hardware and/or programming or with respect to its software, the control device is therefore configured specifically such that, during the printing interruption, the damping unit roller is supplied discontinuously with a damping solution replenishment and, as a result, the damping unit roller is kept ready for a printing operation or conditioned.

The press is a lithographic press, for example an offset press. The damping unit roller to be conditioned in the press is preferably roughened and/or hydrophilic, as already mentioned previously in connection with the method according to the invention.

Other features which are considered as characteristic for the invention are set forth in the appended claims.

Although the invention is illustrated and described herein as embodied in a method of operating a press and a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1A:
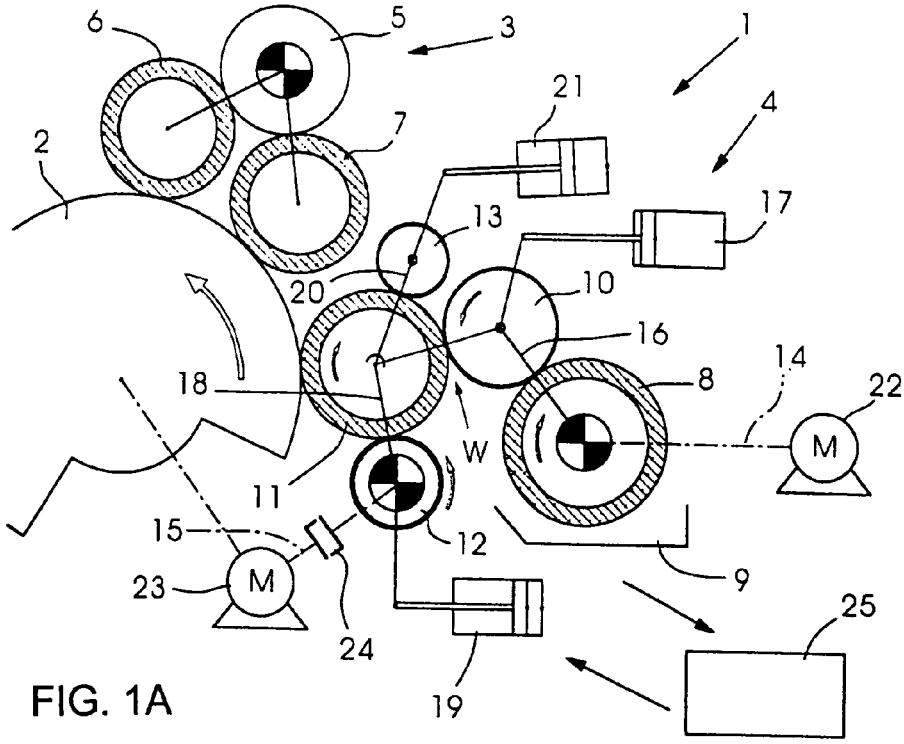
FIGS. 1A and 1B are diagrammatic, sectional views of various printing operation modes of a damping unit.

Referring now to the figures of the drawing in detail and first, particularly, to FIG. 1A thereof, there is shown a press 1 in an extract. The extract shows a printing form cylinder 2 of an offset printing unit of the press 1. The press 1 is a sheet-fed press. An inking unit 3 and a damping unit 4 are assigned to the printing form cylinder 2. The inking unit 3, of which only part is shown, contains an ink distributor roller 5 and ink applicator rollers 6, 7. The damping unit 4 contains a dip roller 8 in a damping solution fountain 9, a transfer roller 10, a damping solution applicator roller 11, a damping unit roller 12 and a bridge roller 13.

The damping solution applicator roller 11 and the dip roller 8 have resilient circumferential surfaces. The transfer roller 10 and the damping unit roller 12 have chromium-plated and therefore hydrophilic circumferential surfaces.

The damping unit roller 12 is additionally roughened on the circumference and is an axially oscillating distributor roller. The damping unit roller 12 has on its circumferential surface a surface structure formed of projecting domes or knobs and depressions lying between these dome-like or knob-like projections. The valley-like depressions are interconnected and form a type of depression network.

In printing operation, the damping unit roller 12 and the dip roller 8 are each mounted in a fixed position and are in each case driven in rotation positively via a gear mechanism 14, 15 indicated only schematically in the drawing.

The transfer roller 10 is mounted in a first pivoting lever 16 and, by the latter and a first actuating drive 17, can be thrown onto and off of the damping solution applicator roller 11, around the dip roller 8. The transfer roller 10 functions as a metering roller and rests permanently on the dip roller 8. The damping solution applicator roller 11 is mounted in a second pivoting lever 18 and, by the latter and a second actuating drive 19, can be thrown onto and off of the printing form cylinder 2, around the damping unit roller 12. The bridge roller 13 is mounted in a third pivoting lever 20 and, by the latter and a third actuating drive 21, can be thrown onto and off of the ink applicator roller 7, around the damping solution applicator roller 11. The actuating drives 17, 19, 21 are pneumatic operating cylinders. The bridge roller 13 and the damping unit roller 12 rest permanently on the damping solution applicator roller 11, the damping unit roller 12 otherwise not resting on any further roller and not on the printing form cylinder 2 either. As viewed in the direction of rotation of the damping solution applicator roller 11, the damping unit roller 12 is disposed immediately downstream of the transfer roller 10 and immediately upstream of the printing form cylinder 2.

An electric, first motor 22 drives the dip roller 8 and the transfer roller 10 together in rotation via the gear mechanism 14. The gear mechanism 14 provides a mechanical connection between the first motor 22 and the dip roller 8 and between the latter and the transfer roller 10, so that the latter is also driven in rotation positively. A controllable clutch 24 is disposed between an electric, second motor 23 and the damping unit roller 12.

Figure 1B:
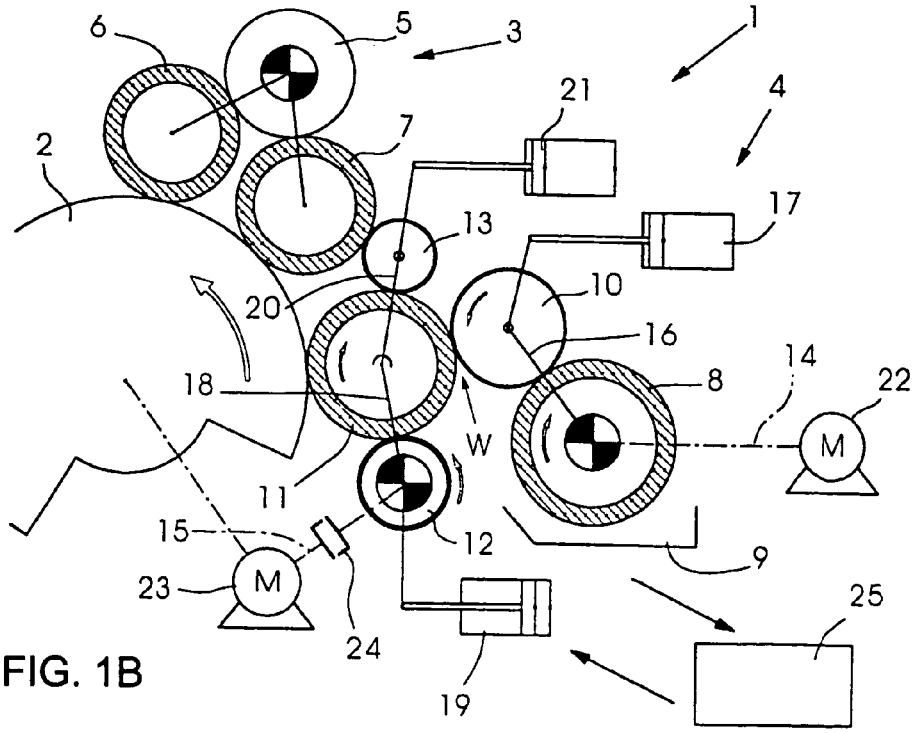

In both printing operation modes (FIGS. 1A and 1B), the clutch 24 is engaged, so that the second motor 23 drives not only the printing form cylinder 2 but also the damping unit roller 12 in rotation. In both printing operation modes, the transfer roller 10 is kept in continuous contact on the damping solution applicator roller 11 by the first actuating drive 17, and the damping solution applicator roller 11 rolls on the rotating printing form cylinder 2. The two printing operation modes differ from each other in that the bridge roller 13 rests on the ink applicator roller 7 in one printing operation mode according to FIG. 1B and, as a result, couples the damping unit 4 to the inking unit 3 and, in the other printing operation mode according to FIG. 1A (and also in the printing interruption modes according to FIGS. 2A to 3B), does not rest on the ink applicator roller 7 and thus decouples the damping unit 4 from the inking unit 3.

In both printing interruption modes according to FIGS. 2A to 3B, the transfer roller 10 executes to and fro movements at periodic intervals or cyclically relative to the damping solution applicator roller 11, such that, although within the printing interruption, the transfer roller 10 is predominantly thrown off the damping solution applicator roller 11 (see FIGS. 2A and 3A) within the printing interruption, it is repeatedly briefly thrown onto the damping solution applicator roller 11 (see FIGS. 2B and 3B), in order during these thrown-on or intermediate damping phases to supply the damping unit roller 12 with a damping solution replenishment from the damping solution fountain 9 via the damping solution applicator roller 11. The thrown-off phases (see FIGS. 2A and 3A), in which a nip W formed by the transfer roller 10 together with the damping solution applicator roller 11 is opened, in each case last longer than the thrown-on or intermediate damping phases, in which the nip W is closed. Therefore, during the printing interruption, the damping unit 4 changes many times from its damping unit position shown in FIG. 2A to its damping unit position shown in FIG. 2B and back again and, respectively, from its damping unit position shown in FIG. 3A to its damping unit position shown in FIG. 3B and back again. Although the associated to and fro movements of the transfer roller 10 have a remote similarity to the movements of a ductor roller, which the damping unit 4 does not have at all, they do not result in the transfer roller 10 being lifted off the dip roller 8 at all. During the printing interruption, in a rhythm determined by an electronic control device 25, the transfer roller 10 is brought into and out of rolling contact with the damping solution applicator roller 11. For this purpose, in a manner corresponding to the rhythm, for example programmed in it, the control device 25 drives the first actuating drive 17, which consequently pivots the first pivoting lever 16 cyclically.

In addition to the common factors described previously, the two printing interruption modes respectively have the below described special features.

Figure 2A:
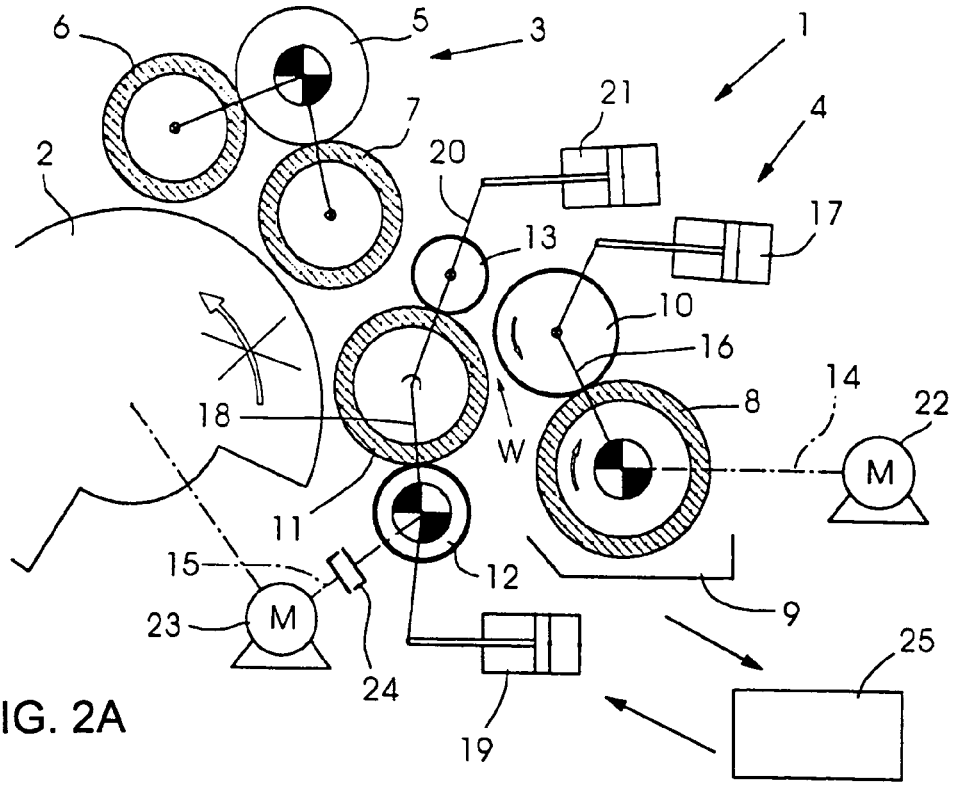
FIGS. 2A and 2B are diagrammatic, sectional views of a first printing interruption mode of the damping unit from FIGS. 1A and 1B.
Figure 2B:
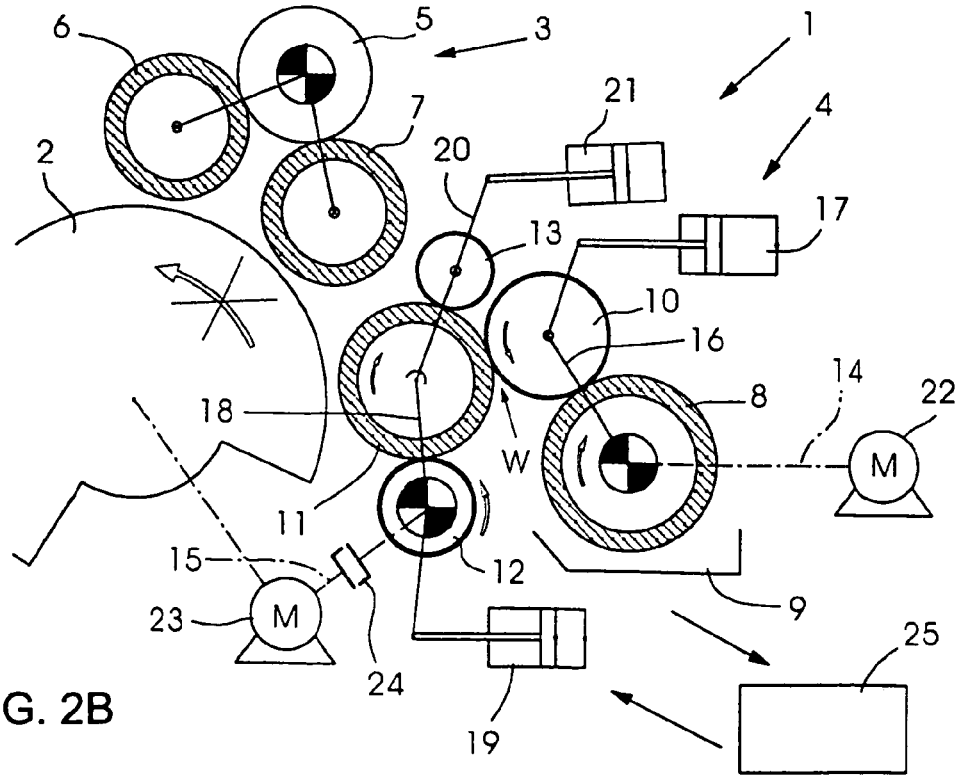

In the first printing interruption mode, shown in FIGS. 2A and 2B, the printing form cylinder 2 does not rotate, the clutch 24 is disengaged and the damping solution applicator roller 11 is lifted off the printing form cylinder 2. During the first printing interruption mode, the second motor 23 can be inactive and the first motor 22 is uninterruptedly active. In the thrown-on or intermediate damping phase (see FIG. 2B), the damping unit roller 12 uncoupled from the second motor 23 is driven by the first motor 22, together with the dip roller 8, the transfer roller 10, the damping solution applicator roller 11 and the bridge roller 13, by the transfer roller 10 driven positively by the first motor 22 rotating the damping solution applicator roller 11 by rolling friction and the latter in turn rotating the damping unit roller 12 and the bridge roller 13, likewise by rolling friction in each case. Accordingly, during the printing interruption, the rollers 11, 12, 13 rotate only in the thrown-on or intermediate damping phase or cyclically and, as opposed to this, the rollers 8, 10 rotate permanently.

However, in a departure from these conditions, according to a modification provision could also be made for the damping unit roller 12 to kept in a drive connection to the second motor 23 during printing operation by a shift gearbox disposed instead of the clutch 24 and, during the printing interruption, instead to be kept in a drive connection to the first motor 22. In the case of this modification, the shift gearbox of the damping unit roller 12 permits a change of its respectively used motor 22, 23 dependent on the operating modes and, during the printing interruption, all the rollers 8, 10 to 13 of the damping unit 4 rotate permanently.

Figure 3A:
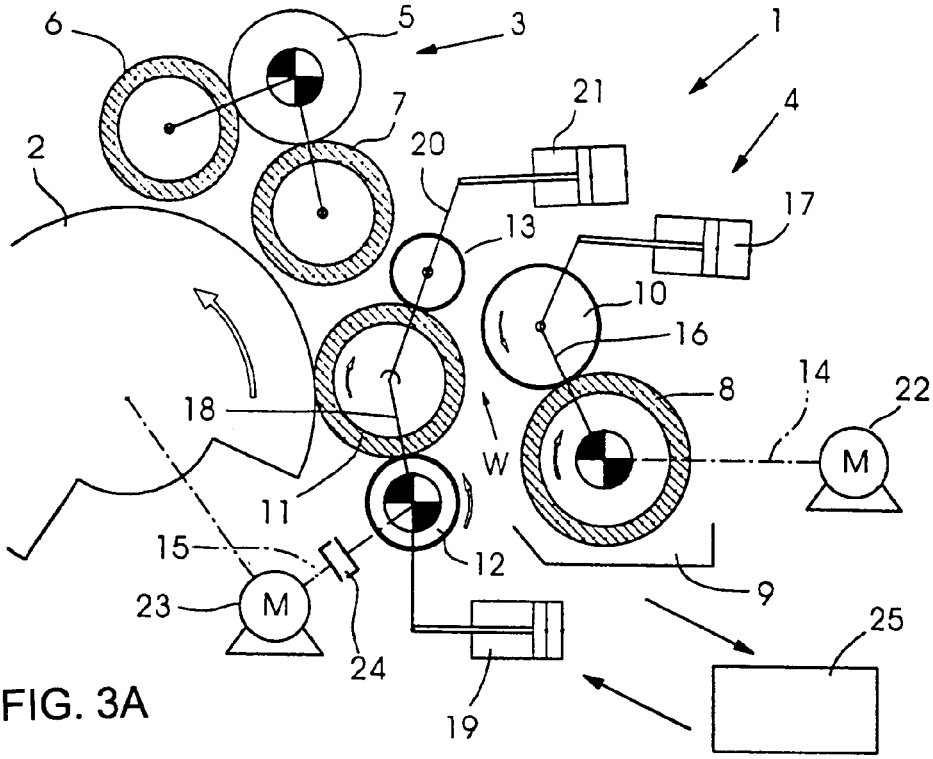
FIGS. 3A and 3B are diagrammatic, sectional views of a second printing interruption mode of the damping unit from FIGS. 1A and 1B.
Figure 3B:
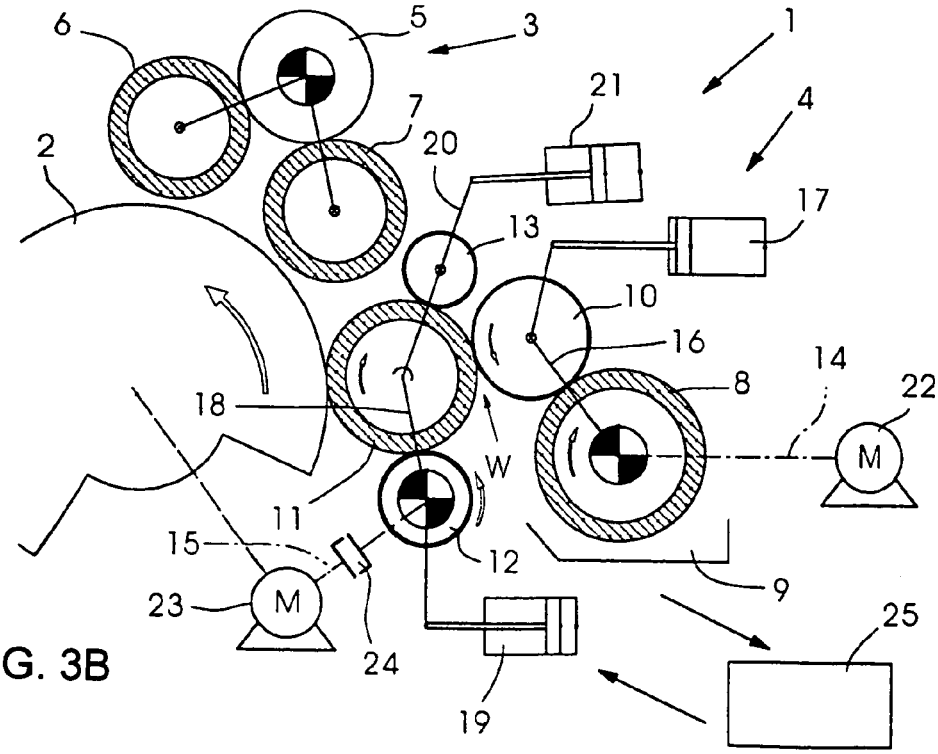

In the second printing interruption mode, which is shown in FIGS. 3A and 3B and is also designated what is known as press idling, the printing form cylinder 2 rotates at a speed which is comparatively slower relative to the printing operation and the clutch 24 is engaged, so that the second motor 23 not only drives the printing form cylinder 2 in rotation but also, at the same time, the damping unit roller 12 as well, positively and permanently. In addition, in this case the second motor 23 drives the damping solution applicator roller 11 via circumferential surface friction (rolling contact between roller 12-roller 11, printing form cylinder 2-roller 11, roller 11-roller 13) of the latter, and the bridge roller 13 in rotation permanently. During the second printing interruption mode, the first motor 22 drives the dip roller 8 and the transfer roller 10 in rotation and thus all the rollers 8, 10 to 13 of the damping unit 4 are rotated permanently. The two motors 22, 23, operating in parallel operation in this case, are synchronized in terms of their rotational speeds by control device 25 or are controlled in a manner coordinated with each other such that, during the thrown-on or intermediate damping phase (see FIG. 3B), no circumferential surface speed difference (slippage) at all or at least no excessively high circumferential surface speed difference occurs between these circumferential surface speeds of the damping solution applicator roller 11 and the transfer roller 10 which comes into discontinuous rolling contact with the latter. As distinct from the first printing interruption mode, during the second printing interruption mode the damping solution applicator roller 11 is kept thrown onto the printing form cylinder 2 by the first actuating drive 17. The to and fro movements of the transfer roller 10 in the thrown-on and thrown-off position relative to the damping solution applicator roller 11 in the second printing interruption mode are carried out at the same rhythm or in accordance with the same movement time profile as in the first printing interruption mode.

It is inherent to the same extent in both printing interruption modes that the damping solution replenishment needed by the damping unit roller 12 for its conditioning (protection against loss of damping solution and collection of the printing ink, maintenance of the hydrophilic surface action) is first scooped from the damping solution fountain 9 by the dip roller 8 and then discharged to the transfer roller 10 and that, after that, the damping solution replenishment is supplied discontinuously from the transfer roller 10 to the damping solution applicator roller 11 and is transferred from the latter to the damping unit roller 12. The volume of this damping solution replenishment can be set by changing the rotational speed of the first motor 22 in such a way that, in the thrown-on or intermediate damping phase, to a certain extent an excess of damping solution is supplied to the damping unit roller 12, by which the emulsion on the damping unit roller 12 is, so to speak, underwashed, as a result of which printing ink already collected in the depressions of the rough surface structure of the damping unit roller 12 is loosened again and washed out of the depressions. The damping solution replenishment fills the depressions freed of the printing ink and subsequently prevents printing ink collecting in the depressions again for a sufficiently long time, for example until the next damping solution replenishment.

This application claims the priority, under 35 U.S.C. § 119, of German patent application No. 103 24 536.7, filed May 28, 2003; the entire disclosure of the prior application is herewith incorporated by reference.

We claim:

1. A method of operating a press, containing a damping unit having a damping unit roller, which comprises the steps of:

during a printing interruption, supplying the damping unit roller discontinuously with a damping solution replenishment for keeping the damping unit roller in a ready state for a printing operation.

2. The method according to claim 1, which further comprises supplying the damping solution replenishment discontinuously to the damping unit roller by a nip within the damping unit first being closed during the printing interruption, so that the damping solution replenishment is supplied to the damping unit roller via the nip, and then being opened again.

3. The method according to claim 2, which further comprises during the printing interruption, repeating a closure of the nip that permits the damping solution replenishment and the opening of the nip alternating with each other.

4. The method according to claim 1, which further comprises during the printing interruption, driving the damping unit roller and a dip roller of the damping unit jointly in rotation by a motor.

5. The method according to claim 4, which further comprises during a printing operation, driving the dip roller in rotation by the motor and, at a same time, a printing form cylinder to which the damping unit is assigned and the damping unit roller are driven jointly in rotation by a further motor.

6. The method according to claim 5, which further comprises putting the printing form cylinder to which the damping unit is assigned at a rotational standstill during the printing interruption.

7. The method according to claim 1, which further comprises using a roughened roller as the damping unit roller.

8. The method according to claim 1, which further comprises using a hydrophilic roller as the damping unit roller.

9. The method according to claim 1, which further comprises using a roller that is in single rolling contact as the damping unit roller.

10. A press, comprising:

a damping unit having a damping unit roller; and an electronic control device for controlling said damping unit, said control device controlling a discontinuous supply of a damping solution replenishment to said damping unit roller during a printing interruption, such that said damping unit roller is kept ready for a printing operation.

11. The press according to claim 10, wherein said damping unit roller has a roughened surface.

12. The press according to claim 10, wherein said damping unit roller is hydrophilic.

* * * * *